US007594489B1

(12) United States Patent
Marrs

(10) Patent No.: US 7,594,489 B1
(45) Date of Patent: Sep. 29, 2009

(54) HIGH VOLTAGE EXTENDER

(75) Inventor: Thomas C. Marrs, Rochester, IN (US)

(73) Assignee: Marshall Electric Corp., Rochester, IN (US)

( * ) Notice: Subject to any disclaimer, the term of this patent is extended or adjusted under 35 U.S.C. 154(b) by 0 days.

(21) Appl. No.: 11/625,219

(22) Filed: Jan. 19, 2007

(51) Int. Cl.
*F02P 15/00* (2006.01)

(52) U.S. Cl. ..... 123/169 PA; 123/143 C

(58) Field of Classification Search ..... 123/143 C, 123/169 PA, 169 PB, 169 PH, 635, 643; 439/125
See application file for complete search history.

(56) References Cited

U.S. PATENT DOCUMENTS 4,944,259 A 7/1990 Richardson
5,060,624 A 10/1991 Bruning et al.
5,357,233 A 10/1994 Wada
5,409,388 A * 4/1995 Phillips et al. ..... 439/125
5,487,676 A * 1/1996 Maruyama et al. ..... 439/125
5,577,921 A 11/1996 Philyaw et al.
5,685,282 A 11/1997 Murata et al.
5,716,223 A * 2/1998 Phillips et al. ..... 439/125
6,068,495 A 5/2000 Virchow
6,340,303 B2 1/2002 Hamada et al.
6,817,872 B1 11/2004 Berg
6,932,627 B2 * 8/2005 Raff et al. ..... 439/125

* cited by examiner

*Primary Examiner*—Stephen K. Cronin
*Assistant Examiner*—Johnny H. Hoang
(74) *Attorney, Agent, or Firm*—Egbert Law Offices PLLC

(57) ABSTRACT

An extender for connecting a high voltage source to a spark plug has a conductive rod with one end suitable for electrical connection to the high voltage source and a second end suitable for electrical connection to the spark plug, and a sleeve injection-molded over the conductive rod so as to be in void-free relation with an exterior surface of the conductive rod. The conductive rod has a first end extending outwardly therefrom. The sleeve defines a spark plug-receiving receptacle at the second end of the conductive rod. An O-ring is received in a notch formed adjacent to the first end of the conductive rod. An O-ring is received in a notch formed around the inner wall of the receptacle. A spring is affixed to the second end of the conductive rod.

8 Claims, 2 Drawing Sheets

HIGH VOLTAGE EXTENDER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to high voltage extenders for connecting a high voltage source to a spark plug. More particularly, the present invention relates to extenders that are used for insulating a conductive rod that is connected to an ignition coil at one end and to a spark plug at an opposite end.

2. Description of Related Art Including Information Disclosed Under 37 CFR 1.97 and 37 CFR 1.98.

Extenders are often used for the connection of high voltage sources, such as ignition coils, to spark plugs. These high voltage extenders are intended to pass the charge from the high voltage source (having a maximum voltage of 40 KV) to the ignition coils. Typically, these extenders are suitably insulated so as to prevent tracking from the conductive rod to the electrical ground created by the engine block.

FIG. 1 illustrates one example of a prior art high voltage extender utilized and sold by Caterpillar, Inc. The high voltage extender 10 has a machined stainless steel rod 12 that has a threaded end 14 and a connecting end 16. The threaded end 14 is machined onto the stainless steel rod 12 so as to connect into the female thread of the high voltage connector of an ignition coil. The connection end 16 connects to the high voltage terminal of a spark plug. A spring 18 is affixed to the connection end 16 of the stainless steel rod 12. The connection is accomplished by compressing the voluted spring 18 against the high voltage terminal of the spark plug. The spring 18 is received within a stainless steel cup 20 which is attached to the stainless steel rod 12. The rod 12 is pressed into a machined sleeve 22 of "void free" polytetrafluoroethylene, otherwise known as TEFLON™. The sleeve 22 serves to insulate the stainless steel rod 12 from the electrical ground created by the ignition block.

As can be seen in FIG. 1, the sleeve 22 has a narrow diameter portion 24 overlying the threaded end 14 of the stainless steel rod 12. A main section 26 of the sleeve 22 extends along the rod 12 from the narrow diameter portion 24. The main section 26 has a greater diameter than the diameter of the narrow diameter portion 24. The sleeve 22 defines a receptacle 28 at an end opposite the narrow diameter portion 24. Receptacle 28 is suitable for receiving a portion of a spark plug therein. An O-ring seal 30 is received within a notch 32 formed in the interior wall of receptacle 28 at the end of the sleeve 22. The sleeve 22 has a constant diameter extending from the narrow diameter portion 24.

Experiments with the prior art of FIG. 1 have determined that during extended periods of high-voltage (30-40 kV), the voltage punctures the polytetrafluoroethylene sleeve at a point where the stainless steel cup 20 is nearest the high voltage terminal of the spark plug. This occurs in an average of 5 to 10 hours when a grounded metal sleeve is placed over the extender 10. During thermal cycling, the polytetrafluoroethylene expands and contracts lengthwise and creates a gap at the inner face surface of the extender 10 and the insulating surface of the high voltage connection of the ignition coil. This allow tracking along the surface to the electrical ground created by the engine block. During shipping, the extender 10 has a tendency to loosen. This also serves to create a gap at the area of the interface of the ignition coil and the extender 10. The polytetrafluoroethylene material "cold flows." This allows the extender 10 to loosen.

In the past, various U.S. patents have issued relating to such high voltage extenders. For example, U.S. Pat. No. 4,944,259, issued on Jul. 31, 1990 to R. D. Richardson, teaches an ignition system with an insulated and extendable extender. This extender resiliently biases the extender between the source of high energy and the spark plug to provide a positive and reliable electrical connection therebetween. The extender is of a relatively rigid construction so as to prevent bending. The extender is combined with a shield in the engine to further protect and increase the functional life of the components.

U.S. Pat. No. 5,060,624, issued on Oct. 29, 1991 to Bruning et al., provides an engine ignition system that has a transformer assembly and positioning means. The transformer assembly has an elongated body having a cup portion containing the coils, a base portion, and a stem portion. A conducting core extends through the stem and base portions. A suitable clip connects the core electrically to a spark plug installed in a profiled bore of the cylinder head. A positioning device is provided to positively align and contain the transformer assembly within a valve mechanism compartment defined between the cover and the cylinder head. A spring member connected to the cup portion. Depending guide members formed within the cover cooperate with each other.

U.S. Pat. No. 5,357,233, issued on Oct. 18, 1994 to Z. Wada, teaches an extension device which extends from the ignition coil to supply the peak high-voltage output to a spark plug. A part of an outer periphery of the secondary coil at an intermediate position of the outer periphery of the secondary coil sinks in relation to the other part of the outer periphery of the secondary coil to form a groove extending in a radial direction of the secondary coil. The peak high-voltage output is transmitted from the secondary coil through the groove to the extension device. The extension device includes a first member extending from the ignition coil, a second member for being connected to the spark plug, and an elastic member connecting the first member to the second member so that the first member moves elastically in relation to the second member.

U.S. Pat. No. 5,577,921, issued on Nov. 26, 1996 to Philyaw et al., discloses an electrical connector system for electrically connecting a voltage source to a spark plug terminal. This transformer assembly has an elongate body including a cup portion containing primary and secondary coils, a base portion, and a stem that is adapted to be installed in a housing of a cylinder head. An electrical source extends through the stem and base portion. An electrical connecting system includes an electrical conductor adapted to receive the voltage source with a spring contacting the end of a spark plug terminal biasing the conductor in a direction away from the spark plug. The electrical connector system further includes a positioning device adapted to positively align and contain the transformer assembly within a valve mechanism compartment defined between a cover and the cylinder head. A spring member is connected to the cup portion so as to axially bias the electrical conductor in a direction toward the spring in contact with the spark plug terminal so as to ensure an electrical connection.

U.S. Pat. No. 5,685,282 issued on Nov. 11, 1997 to Murata et al., discloses an ignition device for an internal combustion engine. This ignition device has a spark plug including a high voltage terminal, an ignition coil for generating a high voltage, and adapter assembly for electrically connecting the ignition coil to the high voltage terminal of the spark plug. The adapter assembly has a support sleeve for accommodating and supporting the high voltage terminal of the spark plug against a transverse movement of the high voltage terminal. The support sleeve is either a continuous extension or a metal tube of the adapter assembly. The assembly may also include a wear-resistant material.

U.S. Pat. No. 6,068,495, issued on May 30, 2000 to F. Virchow, discloses a sparkg plug for an internal combustion engine. A connector sleeve is formed of an insulating material. An elastic member is connected to the connector sleeve so as to seal the gap between the connector sleeve and a spark plug well. A ceramic inlet is formed in the connector sleeve so as to enclose the plug-in contact and the ignition cable connection.

U.S. Pat. No. 6,340,303, issued on Jan. 22, 2002 to Hamada et al., describes a high tension connection for the spark plug of an internal combustion engine. This connection portion has a first high tension connection terminal, a second high tension connection terminal for electrically connecting with the first high tension connection terminal, a locking mechanism provided between the first high tension connection terminal and the second high tension connection terminal for restricting the separation therebetween in the axial direction, and a spring member disposed between the first high tension connection terminal and the second high tension connection terminal. This device serves to prevent an instantaneous breakdown of the connection if an external force is applied to the high tension portion.

U.S. Pat. No. 6,817,872, issued on Nov. 16, 2004 to S. M. Berg, describes a heat-protective spark plug extension. The extender includes an elongated body formed of heat resistant and electrically insulative material that extends between a spark plug engagement end and a spark plug wire connector end. A conductor is located within the body and includes a fitting adapted to releasably electrically connect to a spark plug wire. A receptacle is adapted for electrical connection to a spark plug. An adjustment part permits adjustable movement of the spark plug wire connector end relative to the conductive receptacle.

It is an object of the present invention to provide an extender which assures that the insulating material is void-free.

It is another object of the present invention to provide an extender which seals an interface between the extender and the ignition coil and serves to prevent high voltage leakage.

It is another object of the present invention to provide an extender which prevents movement of the rod within the sleeve rotationally and lengthwise.

It is still a further object of the present invention to provide an extender which is resistant to the corona created in the engine block.

It is a further object of the present invention to provide an extender which is easy to manufacture, easy to install and use, and relatively inexpensive.

These and other objects and advantages of the present invention will become apparent from a reading of the attached specification and appended claims.

BRIEF SUMMARY OF THE INVENTION

The present invention is an extender for connecting a high voltage source to a spark plug. The extender of the present invention comprises a conductive rod having a first end and a second end, with an injection-molded sleeve over the conductive rod so as to be in void-free relation with an exterior surface of the conductive rod. The first end of the conductive rod is suitable for electrical connection to the high voltage source. The second end of the conductive rod is suitable for electrical connection to the spark plug. The conductive rod has the first end extending outwardly of the sleeve. The sleeve defines a spark plug-receiving receptacle at the second end of the conductive rod.

The sleeve has a narrow diameter portion adjacent the first end of the conductive rod. This narrow diameter portion has a notch extend therearound. An O-ring is received in the notch and extends around the narrow diameter portion. The sleeve has an abutment ring formed on a side of the O-ring opposite the first end the conductive rod. This abutment ring is integrally formed with the sleeve. The abutment ring has a greater diameter than a diameter of the narrow diameter portion. The sleeve has a main section extending around the conductive rod from the abutment ring to the receptacle. This main section is of generally constant diameter less than the diameter of the abutment ring. This sleeve has an end section extending around the receptacle. The end section has a greater diameter than the diameter of the main section.

A spring is connected to the second end of the conductive rod. The spring is suitable for contacting a terminal of the spark plug. The receptacle has a notch formed around a wall thereof. An O-ring is received in the notch. The receptacle extends outwardly beyond the second end of the conductive rod so as to form a compartment wherein the spark plug can be received and in which the O-ring is in contact with the exterior surface of the spark plug.

The present invention is also a method of forming an extender used for connecting a high voltage source to a spark plug. This method includes the steps of: (1) placing a conductive rod in a mold; (2) injection-molding a sleeve of polymeric material around the conductive rod such that a first end of the conductive rod extends outwardly of an end of the sleeve and such that a spark plug-receiving receptacle is formed at an opposite end of the sleeve; and (3) removing the injection-molded sleeve and conductive rod from the mold.

The method of the present invention also includes forming a narrow diameter portion of the sleeve adjacent to the end of the conductive rod. A notch is formed around the exterior surface of this narrow diameter portion. An elastomeric O-ring is placed into the notch. Also, in the method of the present invention, a notch is formed around an inner wall of the receptacle. An elastomeric O-ring is inserted into this notch such that a portion of the O-ring extends inwardly of the inner wall of the receptacle. A conductive spring is affixed to a second end of the conductive rod. The first end of the conductive rod is threadedly connecting to the high voltage source. The spark plug is inserted into the receptacle such that a terminal of the spark plug is electrically connected to the conductive rod.

DETAILED DESCRIPTION OF THE INVENTION

Figure 1:
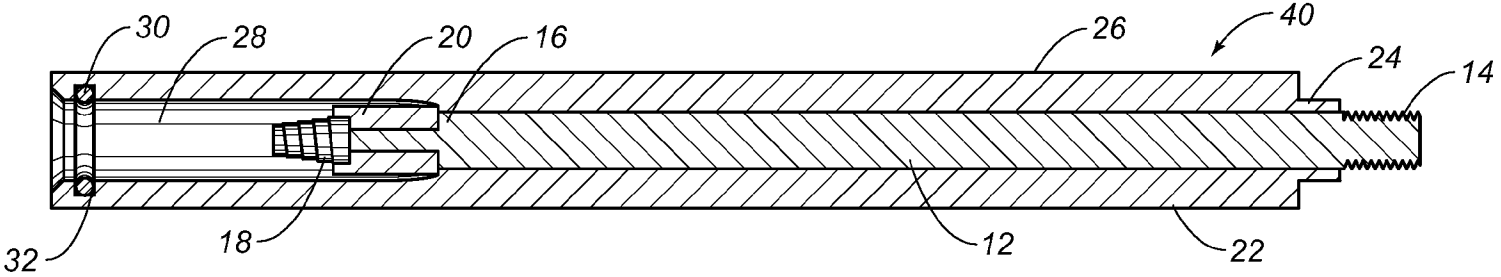
FIG. 1 Prior Art
FIG. 1 is a cross-sectional view showing a prior art extender.
Figure 2:
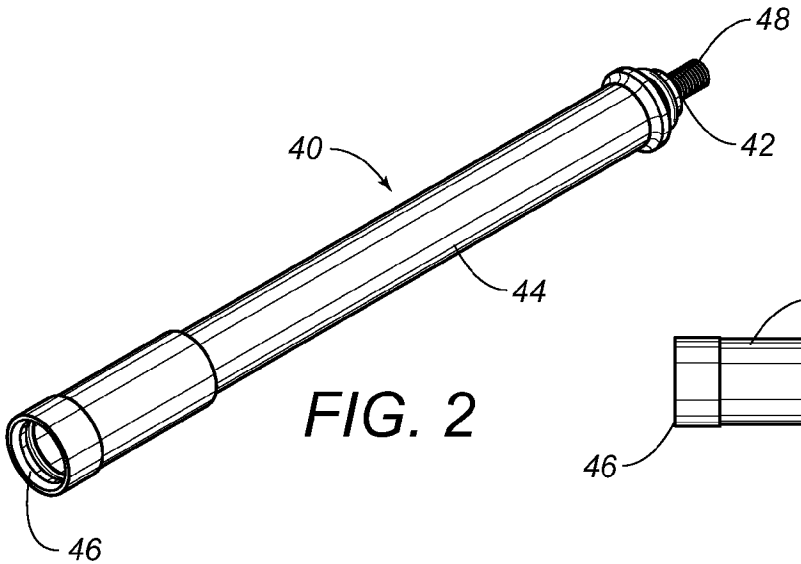
FIG. 2 is a perspective view of the extender of the present invention.

Referring to FIG. 2, there is shown the high voltage extender 40 in accordance with the teachings of the present invention. The high voltage extender includes a conductive rod 42 with a sleeve 44 injection molded thereover. As shown in FIG. 2, the sleeve 44 includes a receptacle 46 suitable for the receipt of a spark plug therein. A threaded connection 48 is formed at the end of the conductive rod 42. The sleeve 44 is injection molded over the conductive rod 42 so as to have a void-free connection with the exterior surface of the conductive rod 42.

Figure 3:
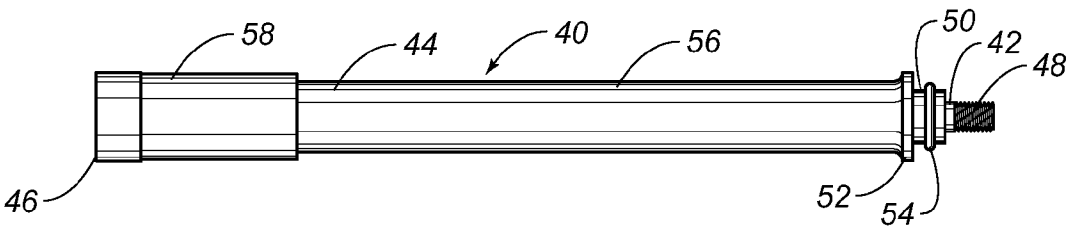
FIG. 3 is a side elevational view of the extender of the present invention.

As can be seen in FIG. 3, the extender 40 has the threaded end 48 of conductive rod 42 extending outwardly of a narrow diameter portion 50 of the sleeve 44. An abutment ring 52 is formed on a side of the narrow diameter portion 50 opposite the threaded connection 48 of the conductive rod 42. An elastomeric O-ring 54 is fitted over the narrow diameter portion 50. The elastomeric O-ring 54 will form an insulating seal with the inner wall of the connection of the ignition coil. The abutment ring 52 will provide an abutment surface against the end of the connection portion of the ignition coil. The abutment ring 52 has a greater diameter than that of the narrow diameter portion 50 and is integrally formed with the sleeve 44 during the injection-molding process. A main section 56 extends from the side of the abutment ring 52 opposite the narrow diameter portion 50. The main section 56 has a generally constant diameter extending longitudinally along the conductive rod 42. The main section 56 has a diameter that is greater than that of the narrow diameter portion 50 and less than that of the abutment ring 52. An end section 58 is formed at the end of the main section 56 opposite the abutment ring 52 and the narrow diameter portion 50. The end section 58 defines the exterior of the receptacle 46. The end section 58 has a diameter slightly greater than that of the main section 56. The narrow diameter portion 50, the abutment ring 52, the main section 56 and the end section 58 are integrally formed together of a polymeric material and in void-free relation with the conductive rod 42. Since a polymeric material is used in the present invention instead of polytetrafluoroethylene, the material used in the present invention is much less expensive than the polytetrafluoroethylene material. Additionally, because of the relatively narrow diameter main section 56, less material is required for the protective sleeve 44 than that of the constant diameter polytetrafluoroethylene sleeve of the prior art.

Figure 4:
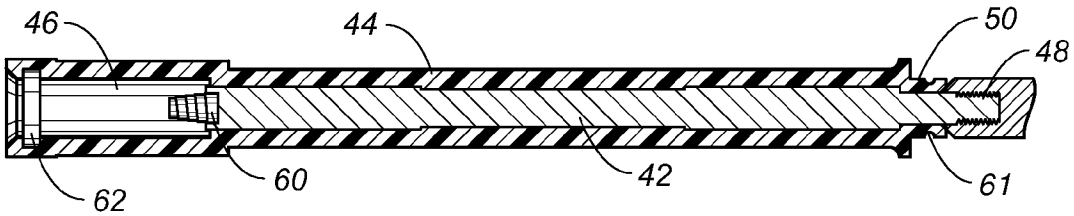
FIG. 4 is a cross-sectional view of the extender of the present invention with the O-ring seals at opposite ends thereof omitted.

FIG. 4 illustrates the conductive rod 42 as received within the sleeve 44. As can be seen, the threaded end 48 extends outwardly of the narrow diameter portion 50 of the sleeve 44. The conductive rod 42 should be formed of a stainless steel material (or any other highly conductive material). Because the sleeve 44 is injection molded over the exterior surface of the conductive rod 42, there can be no voids in the space between the exterior surface of the conductive rod 42 and the inner surface of the sleeve 44. A spring 60 is affixed to the end of the conductive rod 42 within the interior of the receptacle 46 at the end of the conductive rod 42 opposite the threaded connection 48. Spring 60 assures a strong electrical connection with a spark plug introduced into the receptacle 46.

In FIG. 4, it can be seen that there is a notch 61 formed on the exterior surface of the narrow diameter portion 50. Notch 61 provides an area into which the O-ring 54 can be received. Similarly, a notch 62 is formed on an inner wall of the receptacle 46. Notch 62 will also be suitable for receiving an O-ring 54 therein.

Figure 5:
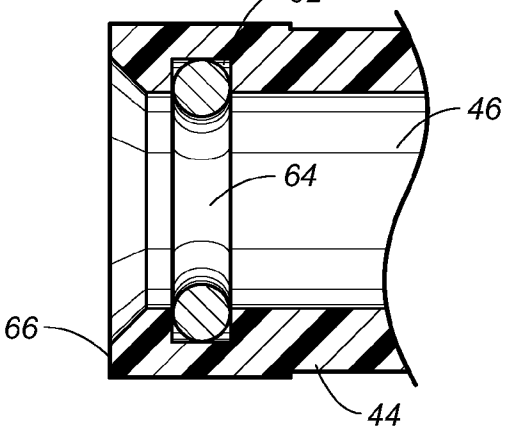
FIG. 5 is detailed view showing the O-ring seal as placed within the end of the receptacle of the extender of the present invention.

FIG. 5 illustrates the O-ring 64 as positioned within the notch 62 in the receptacle 46. The O-ring 64 is positioned adjacent to the end 66 of the sleeve 44.

Figure 6:
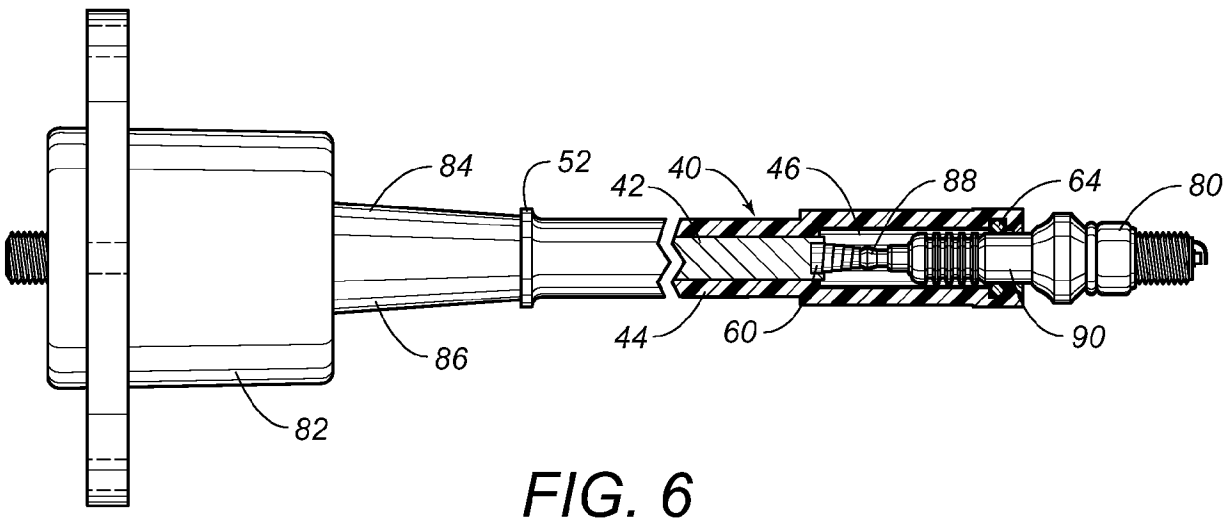
FIG. 6 illustrates the connection of the extender with an ignition coil and a spark plug.

FIG. 6 illustrates how the extender 40 of the present invention is used to connect with a spark plug 80 and an ignition coil 82. The ignition coil 82 has a connection end 84. The threaded connection 48 of the conductive rod 42 is received within the connecting section 84 of the ignition coil 82 and threadedly introduced into a female threaded connector on the interior of the sleeve 86 of the ignition coil 82 extending over the connection section 84. The abutment ring 52 will rest against the end of the connection section 84 of the ignition coil 82. The spark plug 80 has a high voltage terminal 88 that is compressed against the spring 60 so as to establish a strong electrical connection with the conductive rod 42 on the interior of sleeve 44. A portion 90 of the spark plug 80 is introduced into the receptacle 46 at the end of sleeve 44. The O-ring seal 64 will further seal portion 90 within the receptacle 46.

In the present invention, the stainless steel conductive rod 42 is injected molded as an insert in the insulated polymeric sleeve 44 using injection molding techniques so as to ensure that the high voltage insulating material of the sleeve 44 is void free. The surface between the high voltage connection of the ignition coil 84 and the extender 40 utilizes the O-ring 54 on the extender 40 to seal the interface and to prevent high voltage leakage. Because the rod 42 is injection molded as an insert into the high voltage insulating material of sleeve 44, the rod 42 cannot move within the sleeve 44 rotationally or lengthwise. This keeps the surface of the extender 40 at the ignition coil 82 and further prevents high voltage leakage at this point. The materials used in the extender 40 of the present invention are more resistant to the corona created in the engine block. During testing, the extender 40 of the present invention endured 240 hours without failure compared to a maximum of 10 hours for the extender 10 of the prior art.

The foregoing disclosure and description of the invention is illustrative and explanatory thereof. Various changes in the details of the illustrated construction, or in the steps of the described method, can be made within the scope of the appended claims without departing from the true spirit of the invention. The present invention should only be limited by the following claims and their legal equivalents.

I claim:

1. An extender for connecting a high voltage source to a spark plug comprising:

a conductive rod having a first end and a second end, said first end suitable for electrical connection to the high voltage source, said second end suitable for electrical connection to the spark plug;

a sleeve injection-molded over said conductive rod so as to be in void-free relation with an exterior surface of said conductive rod, said conductive rod having said first end extending outwardly therefrom, said sleeve defining a spark plug-receiving receptacle at said second end of the conductive rod, said sleeve having a narrow diameter portion adjacent said first end of said conductive rod, said narrow diameter portion having a notch extending therearound; and an O-ring received in said notch and extending therearound, said sleeve having an abutment ring formed on a side of said O-ring opposite said first end of said conductive rod, said abutment ring integrally formed with said sleeve, said abutment ring having a greater diameter than a diameter of said narrow diameter portion, said sleeve having a main section extending around said conductive rod from said abutment ring to said receptacle, said main section being a generally constant diameter less than the diameter of said abutment ring and greater than the diameter of said narrow diameter portion.

2. The extender of claim 1, said sleeve having an end section extending around said receptacle, said end section having a greater diameter than the diameter than the diameter of said main section.

3. The extender of claim 1, further comprising:

a spring affixed to said second end of said conductive rod suitable for contacting a terminal of the spark plug.

4. the extender of claim 1, said receptacle having a notch formed around a wall thereof, the extender further comprising:

another O-ring received in said notch.

5. The extender of claim 1, said receptacle extending outwardly beyond said second end of said conductive rod.

6. An apparatus comprising:

an ignition coil having a connection extending therefrom;

a spark plug having a terminal at an end thereof;

a conductive rod having a first end and a second end, said first end electrically connected to said connection of said ignition coil, said second end being electrically connected to said terminal of said spark plug; and a sleeve molded over said conductive rod so as to be in void-free relation with an exterior surface of said conductive rod, said first end of said conductive rod extending outwardly of said sleeve, said sleeve defining a receptacle having an interior receiving a portion of said spark plug therein, said connection of said ignition coil being interiorly threaded, said first end of said conductive rod being threadedly connected with the interiorly threaded connection of said ignition coil, said sleeve having a narrow diameter portion at a first end of said conductive rod, said narrow diameter portion having a notch extending therearound;

an O-ring received in said notch and extending therearound, said O-ring interposed between said connection of said ignition coil and said narrow diameter portion of said sleeve, said sleeve having an abutment ring formed on a side of said O-ring opposite said first end of said conductive rod, said abutment ring integrally formed with said sleeve, said abutment ring having a greater diameter than a diameter of said narrow diameter portion, said abutment ring being in abutment with an end of said connection of said ignition coil, said sleeve having a main section extending around said conductive rod from said abutment ring to said receptacle, said main section having a generally constant diameter less than the diameter of said abutment ring, said sleeve having an end section extending around said receptacle, said end section having a greater diameter than the diameter of said main section.

7. The apparatus of claim 6, further comprising:

a spring affixed to said second end of said conductive rod, said spring contacting said terminal of said spark plug.

8. The apparatus of claim 6, said receptacle extending outwardly beyond said second end of said conductive rod, said receptacle having a notch formed around a wall thereof, the apparatus further comprising:

another O-ring received in said notch, said another O-ring being in sealing relation with an exterior of said portion of said spark plug.

* * * * *